US007803000B2

(12) United States Patent
Takayama

(10) Patent No.: US 7,803,000 B2
(45) Date of Patent: Sep. 28, 2010

(54) WIRE CONNECTION UNIT

(75) Inventor: Tsutomu Takayama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/648,739

(22) Filed: Dec. 29, 2009

(65) Prior Publication Data

US 2010/0178785 A1 Jul. 15, 2010

(30) Foreign Application Priority Data

Jan. 13, 2009 (JP) ..... 2009-005007

(51) Int. Cl.
*H01R 4/66* (2006.01)

(52) U.S. Cl. ..... 439/98; 439/579

(58) Field of Classification Search ..... 439/92, 439/98, 578, 579; 174/51
See application file for complete search history.

(56) References Cited

U.S. PATENT DOCUMENTS 7,354,283 B2 * 4/2008 Onuma et al. ..... 439/92
7,503,776 B1 * 3/2009 Pavlovic et al. ..... 439/98
2007/0072455 A1 3/2007 Onuma et al.

FOREIGN PATENT DOCUMENTS

JP 2007-103182 A 4/2007

* cited by examiner

*Primary Examiner*—Khiem Nguyen
(74) *Attorney, Agent, or Firm*—Sughrue Mion, PLLC

(57) ABSTRACT

A wire connection unit includes a connector electrically connecting a first wire and a second wire, a first case and a second case. The second case is joined with the first case, and has an inner face opposing the first case. The inner face is formed with a first groove adapted to hold the first wire and the second wire, a second groove intersecting the first groove, and a first concave portion. The first concave portion is disposed at a part of the first groove except for a position where the second groove intersects the first groove, and accommodating the connector. One of a braided wire pulled out from the first wire and an earth wire electrically connected to the braided wire is accommodated in the second groove. The second groove communicates between a first outside face of the second case and a second outside face of the second case, the second outside case opposite to the first outside face.

6 Claims, 5 Drawing Sheets

WIRE CONNECTION UNIT

BACKGROUND

The present invention relates to a wire connection unit and more particularly to a wire connection unit which accommodates a metallic connector for connecting together ends of two wires including a shielded wire.

In recent years, many coaxial cables (hereinafter, referred to as shielded wires) are used as antenna cables in audio equipment installed on automotive vehicles. For such a shielded wire to be connected with a general wire (non-shielded wire), in many cases, a core wire of the shielded wire and a core wire of the general wire are clamped together by a metallic connector, and a metal piece which extends from a metallic wire device called an earth plate is clamped to a braided wire which surrounds concentrically the core wire of the shielded wire, so that the braided wire is earthed (for example, refer to Patent Document 1).

In the connecting construction described above, normally, a short circuit between the metallic connector and the earth plate is prevented by covering an area which includes the metallic connector which connects the core wires together and a distal end side of the braided wire with an insulative heat-shrinkable tube. The heat-shrinkable tube used here is such as to be shrunk by being applied with heat while allowing an adhesive provided in the tube to melt, so that the tube so shrunk bonds the metallic connector and the like together.

[Patent Document 1] Japanese Patent Publication No. 2007-103182 A

As has been described above, according to the connecting construction of Patent Document 1, the connecting area between the shielded wire and the general wire is covered with the heat-shrinkable tube, and this requires a heating step after the ends of the two wires have been clamped together by the metallic connector. Thus, not only is the number of working steps increased, but also the heating facility needs to be controlled.

Since the metallic piece of the earth plate is clamped to the braided wire which is exposed from the shielded wire in a predetermined direction, the directionality of the earth plate with respect to the shielded wire is fixed, leading to a problem that the degree of freedom in arrangement of the earth plate is restricted.

SUMMARY

It is therefore one advantageous aspect of the present invention to provide a wire connection unit which can obviate the necessity of a heat-shrinkable tube and which can improve the degree of freedom in arrangement of an earth plate.

According to one aspect of the invention, there is provided a wire connection unit, comprising:

a connector, electrically connecting a first wire and a second wire;

a first case; and a second case, joined with the first case, and having an inner face opposing the first case, the inner face formed with:

a first groove, adapted to hold the first wire and the second wire;

a second groove, intersecting the first groove; and a first concave portion, disposed at a part of the first groove except for a position where the second groove intersects the first groove, and accommodating the connector, wherein one of a braided wire pulled out from the first wire and an earth wire electrically connected to the braided wire is accommodated in the second groove, and wherein the second groove communicates between a first outside face of the second case and a second outside face of the second case, the second outside case opposite to the first outside face.

The wire connection unit may further comprise an earth connector electrically connecting the braided wire and the earth wire, and may be configured such that: the inner face is formed with a second concave portion accommodating at least a part of the earth connector; and the second concave portion is spaced apart from the first concave portion.

The wire connection unit may be configured such that: the first wire is a shielded wire in which a core wire is shielded concentrically therearound by the braided wire; the second wire is a non-shielded wire.

The wire connection unit may be configured such that: the inner face of the second case has a first part and a second part which are divided by the second groove; and a width of the first part of the inner face is different from a width of the second part of the inner face in a direction orthogonal to an extending direction of the first groove.

The wire connection unit may be configured such that: the first case has a same shape as the second case.

According to another aspect of the invention, there is provided a wire connection unit, comprising:

a connector, electrically connecting a shielded wire and a non-shielded wire, the shielded wire in which a core wire is shielded concentrically therearound by a braided wire;

an earth conductor electrically connected to the braided wire of the shielded wire;

a first case; and a second case, joined with the first case, and having an inner face opposing the first case, the inner face formed with:

a first groove, adapted to hold the shielded wire and the non-shielded wire;

a second groove, intersecting the first groove, and accommodating the earth conductor; and a first concave portion, disposed at a part of the first groove except for a position where the second groove intersects the first groove, and accommodating the connector, wherein the second groove communicates between a first outside face of the second case and a second outside face of the second case, the second outside case opposite to the first outside case, wherein the earth conductor includes: a body part disposed in the second groove and held by the first case and the second case; and a curved part formed at an end of the body part and connected with the braided wire.

DETAILED DESCRIPTION OF EXEMPLIFIED EMBODIMENTS

First Embodiment

Hereinafter, an embodiment to which the invention is applied will be described by reference to the drawings.

In this embodiment, although a wire connection unit will be described which accommodates a connecting portion between a shielded wire and a general wire (a non-shielded wire), two wires to be connected are not limited to those described in the embodiment. For example, the wire connection unit of the embodiment can also be applied to a case in which two shielded wires are connected together.

The shield wire is a coaxial cable which is connected to an antenna installed on a vehicle and is, made up of a core wire, an insulation layer which covers the core wire concentrically, a braided wire which is made up of a conductor which covers an insulation material concentrically and a covering portion of a synthetic resin which covers the braided wire. The general wire and the earth wire are a wire which is made up of a core wire into which a plurality of metallic threads of aluminum or the like are bundled up and a covering portion of a synthetic resin which covers the core wire.

Figure 1:
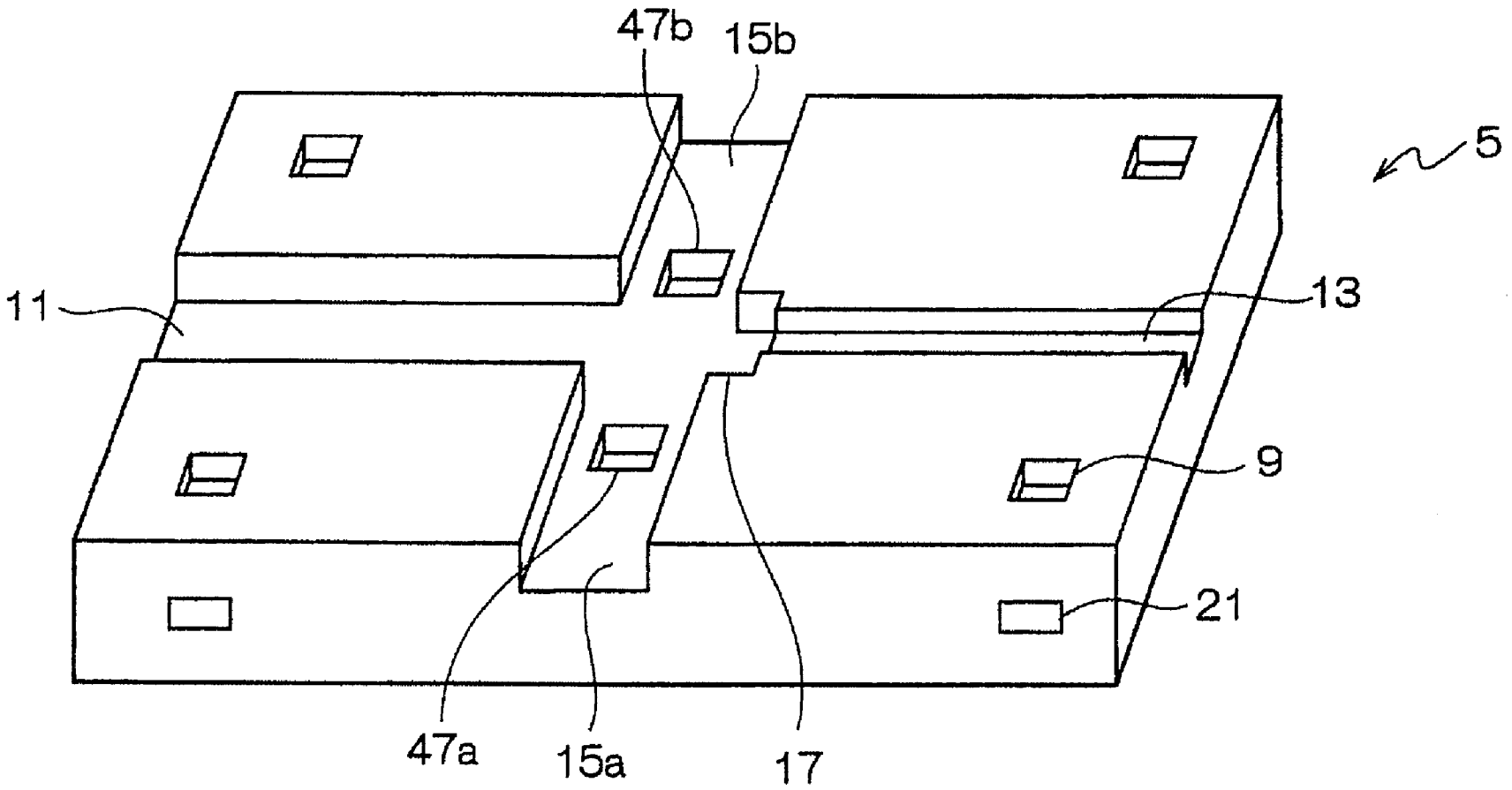
FIG. 1 is a perspective view showing a lower case of a wire connection unit of a first embodiment of the invention that is to be revealed when the wire connection unit is opened.
Figure 2:
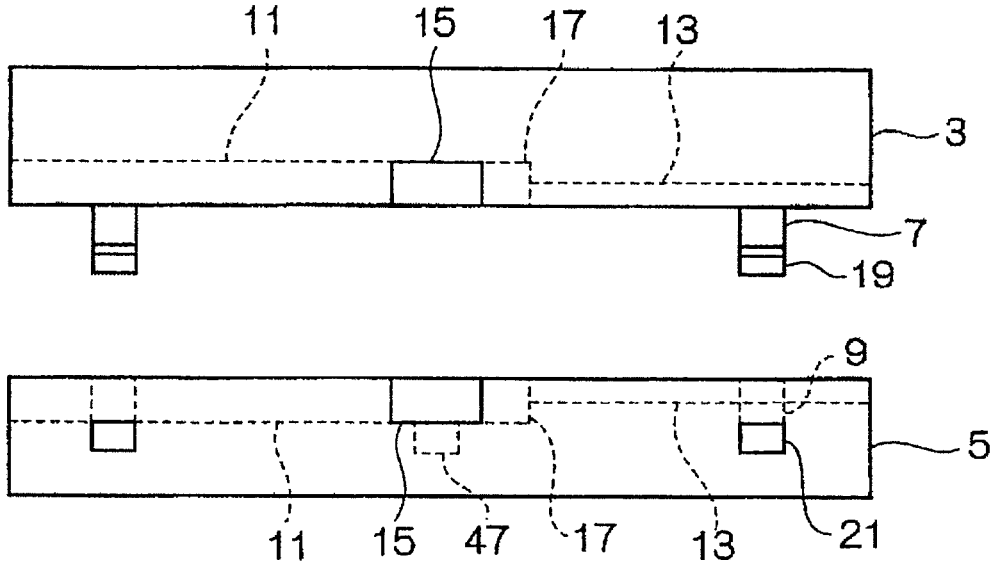
FIG. 2 is a side view showing an upper case of the wire connection unit of the first embodiment of the invention with the lower case.
Figure 3:
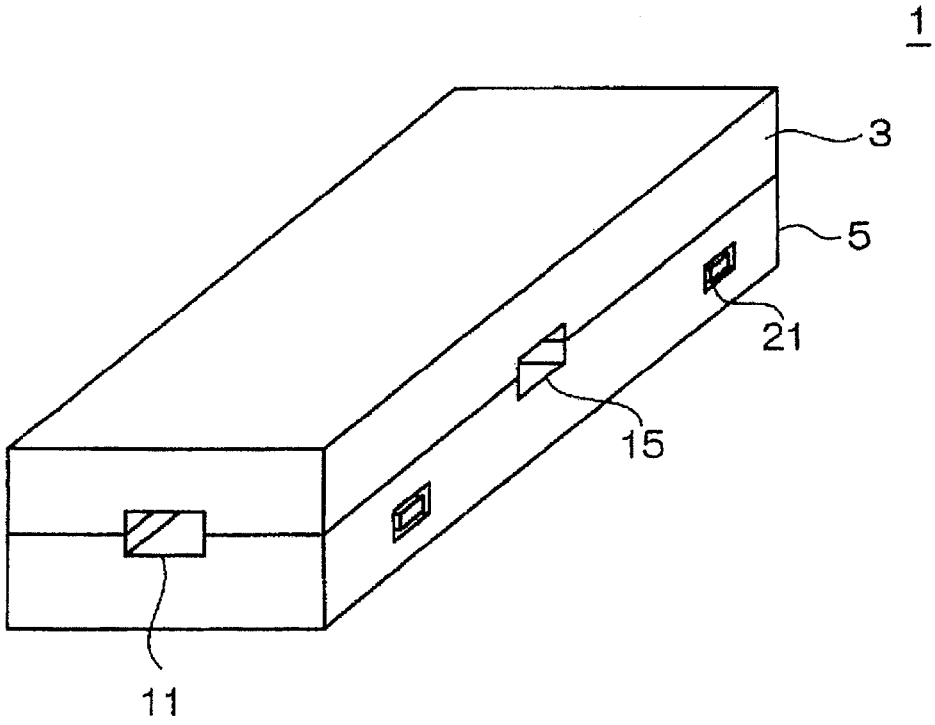
FIG. 3 is a perspective view showing the wire connection unit of the first embodiment of the invention in which the upper and lower cases are closed.
Figure 4:
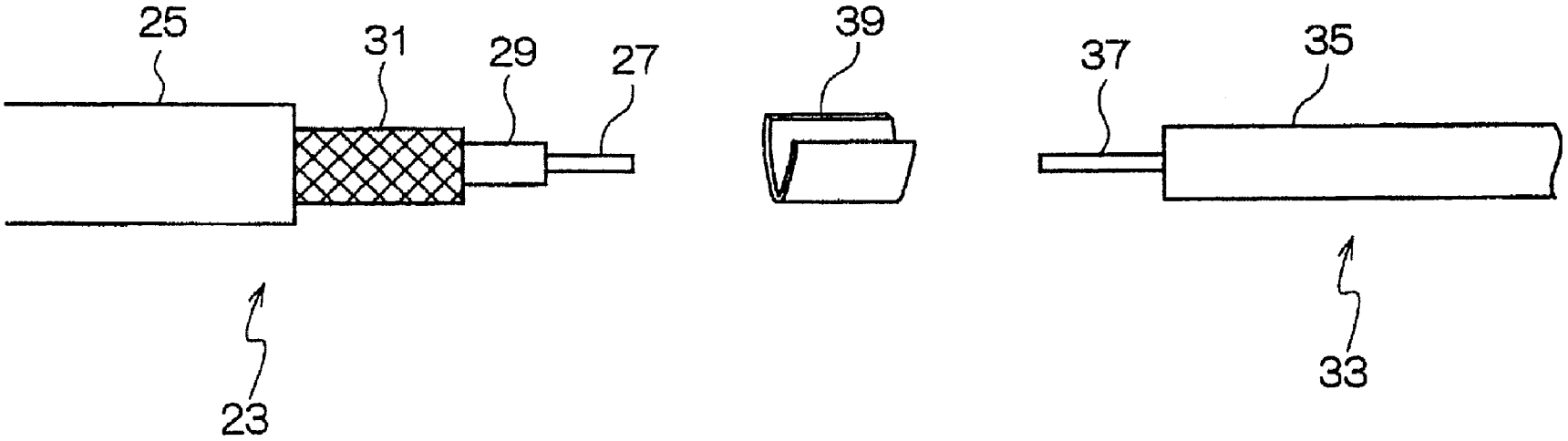
FIG. 4 is a drawing illustrating an example in which an end of a shielded wire is connected with an end of a general wire in the wire connection unit of the first embodiment of the invention.

As is shown in FIGS. 1 to 3, a wire connection unit 1 is divided into two halves such as an upper case and a lower case, and the closure of the upper case 3 and the lower case 5 is held by fitting respectively locking claws 7 formed in four locations on an inner face of the upper case 3 in corresponding locking grooves 9 formed in the lower case 5. A shielded wire groove 11, a general wire groove 13 and earth grooves 15 are formed on an inner face (an upper face in FIG. 1) of the lower case 5, and a shielded wire is laid out in the shield wire groove 11, a general wire is laid out in the general wire groove 13, and an earth wire is laid out in either of the earth grooves 15.

The shielded wire groove 11 and the general wire groove 13 are provided in a continuous straight line with their groove center lines coinciding with each other which extends between both facing side faces (left and right side faces in FIG. 1) of the lower case 5. The earth grooves 15 intersect the shielded wire groove 11 and the general wire groove 13 in a position where the two wire grooves meet and are provided so as to extend between both facing side faces (upper and lower side faces in FIG. 1) of the lower case 5. The earth grooves 15 may intersect the shielded wire groove 11 orthogonally or obliquely.

A depth of the shielded wire groove 11 is set deeper than a depth of the general wire groove 13. This is because an outside diameter of the shielded wire differs from that of the general wire groove. Consequently, a width of the shielded wire groove 11 is set larger than a width of the general wire groove 13. A depth of the earth groove 15 is set to a depth equal to the depth of the shielded wire groove 11. However, the earth groove 15 may be formed shallower than the shielded wire groove.

As is shown in FIG. 1, a metallic connector accommodation groove 17 is provided at a boundary portion where the general wire groove 13 meets the earth grooves 15, and this metallic connector accommodation groove 17 has a depth which is equal to the depth of the shielded wire groove 11 and a width which is smaller than that of the shielded wire groove 11 but is larger than that of the general wire groove 13. A metallic connector (which will be described later) is to be accommodated in the metallic connector accommodation groove 17, which metallic connector is adapted to connect the shielded wire with the general wire. The depth and width of the metallic connector accommodation groove 17 can be set as required in accordance with a size of a metallic connector to be used.

As is shown in FIGS. 2 and 3, a shielded wire groove 11, a general wire groove 13, earth grooves 15 and a metallic connector accommodation groove 17 are formed individually on an inner face of the upper case 3 in positions where they face correspondingly the shielded wire groove 11, the general wire groove 13, the earth grooves 15 and the metallic connector accommodation groove 17 which are formed on the inner face of the lower case 5. In this embodiment, since the case of the wire connection unit is divided equally into the upper and lower cases, the respective widths and depths of the grooves are set equally on the upper and lower cases. However, the invention is not limited to the embodiment, and a configuration may be adopted in which the respective grooves are formed only on the lower case 5 and the upper case 3 only has a function as a lid.

As is shown in FIGS. 1 and 2, earth metallic connector accommodation grooves 47*a*, 47*b* are formed in bottoms of the earth grooves 15*a*, 15*b* in positions which are equidistant from the shielded wire groove 11, respectively, and metallic connectors 45, which will be described later, are accommodated at least partially in the earth metallic connector accommodation grooves 47*a*, 47*b* so formed. In this embodiment, the earth metallic connector accommodation grooves 47 are formed only in the lower case 5. However, earth metallic connector accommodation grooves may be formed individually in corresponding positions on the upper and lower cases.

Both the upper case 3 and the lower case 5 are formed from a synthetic resin. The locking claws 7 are provided on the inner face of the upper case 3 so as to be erected therefrom, and hooks 19 (FIG. 2) are formed at distal end portions of the locking claws 7 so as to project in a direction which is substantially at right angles to the direction in which the locking claws 7 are erected (outwards). The locking grooves 9 are formed on the inner face of the lower case 5. Through holes 21 are provided inside the locking grooves 9 so as to open to side faces of the lower case, and when the locking claws 7 are fitted in the locking grooves 9, the hooks 19 enter the corresponding through holes 21 to thereby be brought into engagement therewith.

In a shielded wire 23 that is to be assembled to the wire connection unit 1 which is configured as has been described heretofore, a covering portion 25 is stripped off at an end portion thereof so that a core wire 27, an insulation layer 29 and a braided wire 31 are exposed sequentially in that order from a distal end portion. In a general wire 33, a covering portion 33 is stripped off at an end portion thereof so that a core wire 37 is exposed. The core wire 27 of the shielded wire 23 and the core wire 37 of the general wire 33 are connected together by a joint terminal 39 which constitutes a metallic connector.

The joint terminal 39 is an open barrel terminal, for example, which is made up of a metallic member, and the core wire 27 of the shielded wire 23 and the core wire 37 of the general wire 33 are clamped together by the joint terminal 39 in such a state that the core wire 27 and the core wire 37 are joined through butt joint. The joint terminal 39 can be made up of a hollow cylindrical sleeve, an insulation tube and the like and various members can be used to make up the joint terminal 39, provided that they can connect electrically the core wire 27 and the core wire 37 together.

The end portion of the shielded wire 23 is made into an integral portion by twisting the braided wire 31 which covers the core wire 27 therearound. In an earth wire 41, similar to the general wire 33, a covering portion is stripped off at an end portion so that a core wire 43 is exposed. This exposed core wire 43 and an end portion of the braided wire 31 which is twisted into the integral portion are electrically connected together by a metallic connector 45 such as a joint terminal.

Figure 5:
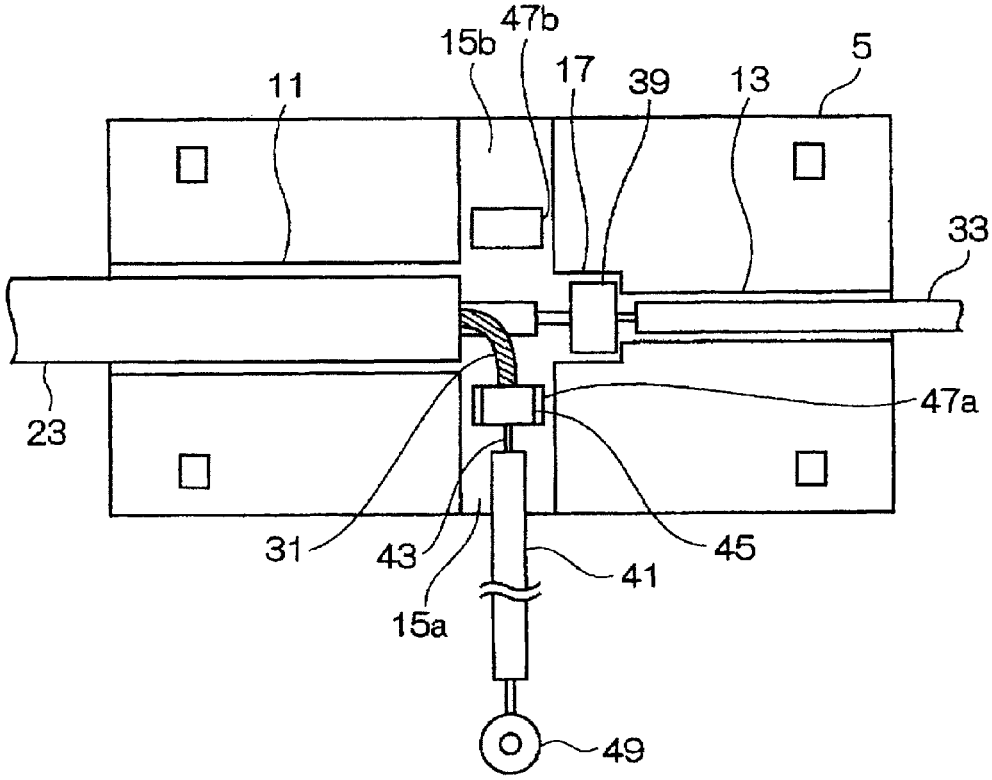
FIG. 5 is a plan view showing a layout of the shielded wire, the general wire and an earth wire on the lower case of the wire connection unit of the first embodiment of the invention.

Next, operations occurring when the wires are assembled into the wire connection unit 1 of this embodiment will be described. As is shown in FIG. 5, in the lower case 5, the shielded wire 23 is disposed in the shielded wire groove 11, and the general wire 33 is disposed in the general wire groove 13. In this state, the joint terminal 39 is disposed in the metallic connector accommodation groove 17. As this occurs, since the shielded wire groove 11 and the general wire groove 13 are the different grooves, there occurs no such situation that the shielded wire 23 is disposed in the general wire groove 13 and the general wire 33 is disposed in the shielded wire groove 11. On the other hand, the earth wire 41 is disposed in either of the earth grooves 15*a*, 15*b* which is predetermined. As is shown in FIG. 5, when the earth wire 41 is disposed in the earth groove 15*a*, a metallic connector 45 for connecting the braided wire 31 which is twisted into the integral portion with the core wire 43 of the earth wire 41 is disposed in the earth metallic connector accommodation groove 47*a* formed in the bottom of the earth groove 15*a*, and the other end side of the earth wire 41 is pulled out of the earth groove 15*a*.

The four locking claws 7 on the upper case 3 are pushed respectively into the corresponding locking grooves 9 with the shielded wire 23, the general wire 33 and the earth wire 41 disposed in the corresponding grooves, respectively, in the way described above. When the locking claws 7 are inserted into the locking grooves 9, the hooks 19 of the locking claws 7 are elastically deformed on their back sides, and when the locking claws 7 has reached deepest positions in the locking grooves 9, the hooks 19 are allowed to fit in the corresponding through holes 21 to thereby be locked therein by virtue of restoring force thereof. By the hooks 19 being locked in the through holes 21, the upper case 3 and the lower case 5 are held together with the inner faces thereof held in abutment with each other.

A terminal 49 having a hole is attached to a distal end of the earth wire 41 which is pulled out of the earth groove 15*a*, the terminal 49 is screwed to an earth plate (not shown) with a screw, whereby the braided wire 31 of the shielded wire 23 is earthed.

According to this embodiment, in the shielded wire 23, since the integrated braided wire 31 is led into the earth groove 15*a* before the joint terminal 39 where the shielded wire 23 is connected with the general wire 33, for example, even though the joint terminal 39 or the like is not covered with a heat-shrinkable tube, the earth wire 41 can be pulled out of the wire connection unit 1 without a risk of the braided wire 31 and the metallic connection unit 45 being brought into contact with the joint terminal 39 or the like, thereby making it possible to simplify the fabrication process.

According to the embodiment, since the earth metallic connector accommodation groove 47 is formed in the earth groove 15, that is, in the position which is spaced apart from the metallic connector accommodation groove 17 so that at least part of the metallic connector 45 is accommodated in the earth metallic connector accommodation groove 47, looseness of the braided wire 31 and the metallic connector 45 within the wire connection unit 1 can be suppressed, thereby making it possible to certainly prevent the braided wire 31 and the metallic connector 45 from being brought into contact with the joint terminal 39. When compared with the conventional art earthing method in which a metallic piece extending from an edge portion of an earth plate is clamped to a braided wire exposed from a shielded wire, in this embodiment, the length of the braided wire exposed can be shortened, which is economical. When assembling the wires, since the metallic connector 45 only has to be disposed within the earth metallic connector accommodation groove 47, the assembling work can be simplified.

According to the embodiment, since the earth grooves 15 extend from the position where they meet the shielded wire groove 11 to both the side faces of the upper and lower cases, the earth wire 41 can be pulled out of either of the side faces of the upper and lower cases via either of the earth grooves 15*a*, 15*b*, so that a leading end of the earth wire 41 so pulled out can be connected to an earth plate (not shown). Because of this, the degree of freedom in disposing the earth plate relative to the shielded wire 23 can be improved.

In this embodiment, after the upper case 3 and the lower case 5 are closed together, the upper case 3 can be removed from the lower case 5 by dislocating the hooks 19 on the locking claws 7 from the through holes 21 in the lower case 5. In this way, with the upper and lower cased separated from each other, for example, the layout position of the braided wire 31 can be changed from the earth groove 15*a* to the earth groove 15*b*, so that the direction in which the earth wire 41 is pulled out from the wire connection unit can be changed as required.

In this embodiment, the two wires are described as being the shielded wire 23 and the general wire 33 that are to be connected together, the invention can also be applied to a case in which ends of two shielded wires 23 are connected together. As this occurs, although two earth wires 41 are pulled out of the wire connection unit, since in both of the shielded wires 23, integrated braided wires 31 need to be led into the earth grooves 15 before the joint terminal 39, earth grooves 15 which intersect the shielded wire groove 11 and the general wire groove 13 are provided so that one earth groove 15 exists on each side of the metallic connector accommodation groove 17. By adopting this configuration, the same function and advantage as those of the embodiment can be provided.

In this embodiment, although the metallic connector 45 is described as being accommodated within the earth groove 15, for example, a configuration may be adopted in which a metallic connector 45 is disposed outside the wire connection unit 1. As this occurs, the braided wire 31 which is integrated from the shielded wire 23 is led into the earth groove 15 so as to be laid out therein, and, for example, one end of the braided wire 31 which is pulled of the wire connection unit 1 is connected with the core wire 43 of the earth wire 41 by the metallic connector 45.

Second Embodiment

Next, a second embodiment to which the invention is applied will be described by reference to the drawings. In this embodiment, like reference numerals will be given to like constituent members to those of the first embodiment, and the description thereof will be omitted here.

Figure 6:
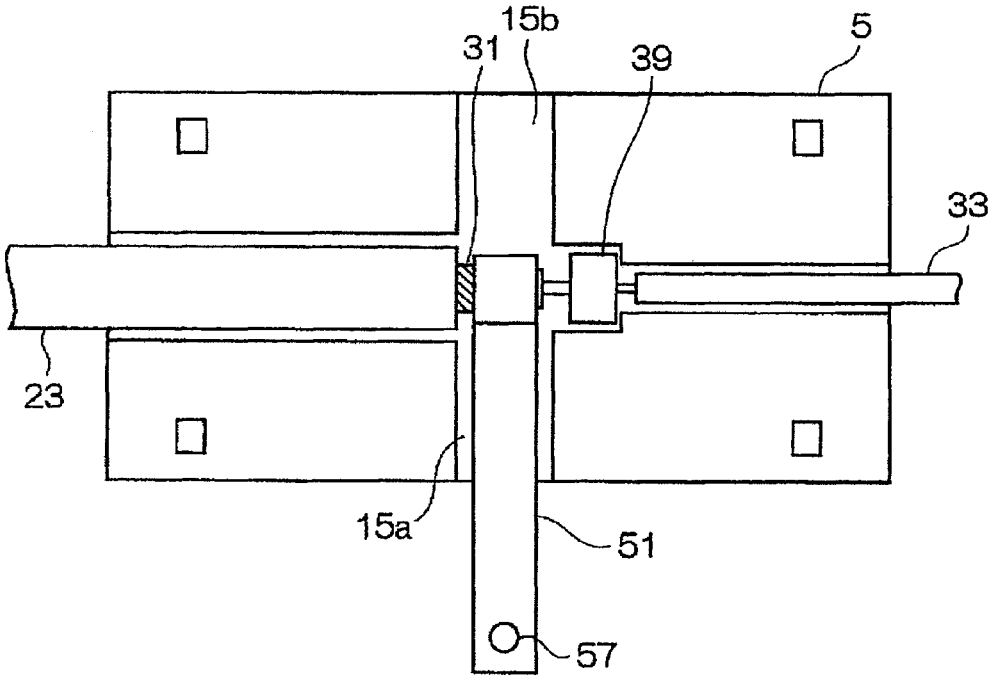
FIG. 6 is a plan view showing a layout of the shielded wire, the general wire and the earth terminal on a lower case of a wire connection unit of a second embodiment of the invention.

As is shown in FIG. 6, a wire connection unit of this embodiment differs from the first embodiment in that a braided wire 31 of a shielded wire 23 is earthed by use of a metallic earth terminal 51 in place of the earth wire 41. The earth terminal 51 used in this embodiment is made up of an elongated body portion 53 and a concavely curved face portion 55 which is provided so as to be consecutive to one end side of the body portion 53.

Figure 7:
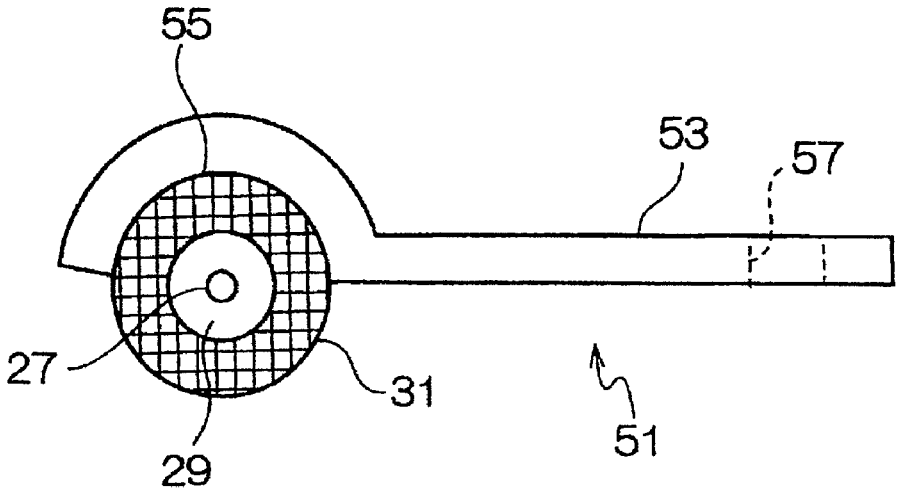
FIG. 7 is a drawing showing a contact between the earth terminal in FIG. 6 with a braided wire.

As is shown in FIGS. 6, 7, the curved face portion 55 of the earth terminal 51 is brought into abutment with the braided wire 31 which is exposed concentrically with a core wire 27 of the shielded wire, and the body portion 53 is disposed in an earth groove 15. In this state, when upper and lower cases are joined together, the body portion 53 of the earth terminal 51 is held in earth grooves formed on the upper and lower cases, while the curved face portion 55 of the earth terminal 51 is brought into contact with the braided wire 31 of the shielded wire 23. Namely, the earth terminal 51 is held in the upper and lower cases while the earth terminal 51 is electrically connected with the braided wire 31. A hole 57 is formed in an end portion of the earth terminal 51 which is pulled out of the upper and lower cases, and the braided portion of the shielded wire 23 is earthed by the earth terminal 51 being screwed to an earth plate (not shown) or the like with a screw.

According to this embodiment, since the upper and lower cases only have to be joined together with the earth terminal 51 disposed in the predetermined position, compared with the case shown in FIG. 5 in which the braided wire 31 is twisted into the integral portion for connection with the earth wire 41, the workability at the time of assemblage can be enhanced remarkably. By changing whereto dispose the body portion 53 of the earth terminal 51 between earth grooves 15*a*, 15*b*, a change in the disposition of the earth plate with respect to the shielded wire 23 can be facilitated.

Third Embodiment

Next, a third embodiment to which the invention is applied will be described by reference to the drawing. In this embodiment, like reference numerals will be given to like constituent members to those of the first embodiment, and the description thereof will be omitted here.

Figure 8:
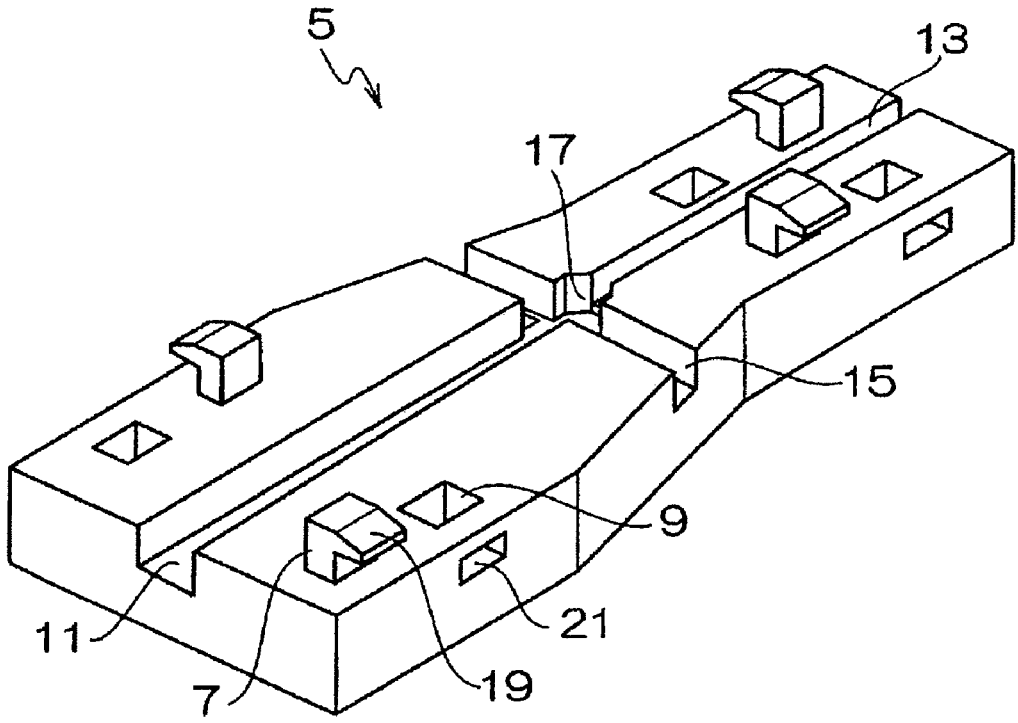
FIG. 8 is a perspective view showing a lower case of a wire connection unit of a third embodiment of the invention.

A wire connection unit of this embodiment differs from those of the first and second embodiments that an upper case 3 and a lower case 5 have the same shape and that a width dimension of a shorter side of the upper and lower cases is made to change along a longitudinal direction of the upper and lower cases. As is shown in FIG. 8, locking claws 7 and locking grooves 9 are provided alternately along the longitudinal direction of the lower case 5 in a right-hand half portion and a left-hand half portion of the lower case 5 which are divided by a shielded wire groove 11 and a general wire groove 13, and the locking claws 7 and the locking grooves 9 are disposed so as to intersect each other between the right-hand half portion and the left-hand half portion.

Since the upper case 3 and the lower case 5 can be used without discrimination by forming the wire connection unit in the way described above, the number of constituent components can be reduced so as to be more economical. Since the upper case 3 and the lower case 5 are formed so as to change their shapes as they extend in the longitudinal direction, an error of disposing a shielded wire 23 and a general wire 33 can be prevented in an ensured fashion so as to enhance the workability.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

The disclosures of Japanese Patent Application No. 2009-005007 filed Jan. 13, 2009 including specification, drawings and claims is incorporated herein by reference in its entirety.

What is claimed is:

1. A wire connection unit, comprising:

a connector, electrically connecting a first wire and a second wire;

a first case; and a second case, joined with the first case, and having an inner face opposing the first case, the inner face formed with:

a first groove, adapted to hold the first wire and the second wire;

a second groove, intersecting the first groove; and a first concave portion, disposed at a part of the first groove except for a position where the second groove intersects the first groove, and accommodating the connector, wherein one of a braided wire pulled out from the first wire and an earth wire electrically connected to the braided wire is accommodated in the second groove, and wherein the second groove communicates between a first outside face of the second case and a second outside face of the second case, the second outside face opposite to the first outside face.

2. The wire connection unit according to claim 1, further comprising:

an earth connector electrically connecting the braided wire and the earth wire, wherein the inner face is formed with a second concave portion accommodating at least a part of the earth connector, and wherein the second concave portion is spaced apart from the first concave portion.

3. The wire connection unit according to claim 1, wherein the first wire is a shielded wire in which a core wire is shielded concentrically therearound by the braided wire, and wherein the second wire is a non-shielded wire.

4. The wire connection unit according to claim 1, wherein the inner face of the second case has a first part and a second part which are divided by the second groove, wherein a width of the first part of the inner face is different from a width of the second part of the inner face in a direction orthogonal to an extending direction of the first groove.

5. The wire connection unit according to claim 1, wherein the first case has a same shape as the second case.

6. A wire connection unit, comprising:

a connector, electrically connecting a shielded wire and a non-shielded wire, the shielded wire in which a core wire is shielded concentrically therearound by a braided wire;

an earth conductor electrically connected to the braided wire of the shielded wire;

a first case; and a second case, joined with the first case, and having an inner face opposing the first case, the inner face formed with:

a first groove, adapted to hold the shielded wire and the non-shielded wire;

a second groove, intersecting the first groove, and accommodating the earth conductor; and a first concave portion, disposed at a part of the first groove except for a position where the second groove intersects the first groove, and accommodating the connector, wherein the second groove communicates between a first outside face of the second case and a second outside face of the second case, the second outside face opposite to the first outside face, wherein the earth conductor includes: a body part disposed in the second groove and held by the first case and the second case; and a curved part formed at an end of the body part and connected with the braided wire.

* * * * *